US011769959B2

(12) United States Patent
Wi et al.

(10) Patent No.: US 11,769,959 B2
(45) Date of Patent: Sep. 26, 2023

(54) TERMINAL AND WIRE WITH TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Nungna Wi, Mie (JP); Masaaki Tabata, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 121 days.

(21) Appl. No.: 17/614,356

(22) PCT Filed: May 22, 2020

(86) PCT No.: PCT/JP2020/020312

§ 371 (c)(1),
(2) Date: Nov. 25, 2021

(87) PCT Pub. No.: WO2020/250642

PCT Pub. Date: Dec. 17, 2020

(65) Prior Publication Data

US 2022/0224037 A1 Jul. 14, 2022

(30) Foreign Application Priority Data

Jun. 11, 2019 (JP) ..... 2019-108474

(51) Int. Cl.
*H01R 13/11* (2006.01)
*H01R 13/422* (2006.01)
(Continued)

(52) U.S. Cl.
CPC ..... *H01R 13/422* (2013.01); *H01R 4/18* (2013.01); *H01R 4/28* (2013.01); *H01R 13/113* (2013.01); *H01R 43/16* (2013.01)

(58) Field of Classification Search
CPC ..... H01R 4/18; H01R 4/28–13/113; H01R 13/422; H01R 13/114–43/16
See application file for complete search history.

(56) References Cited

U.S. PATENT DOCUMENTS 4,597,622 A 7/1986 Coe
6,305,992 B1 10/2001 Bouda et al.
(Continued)

FOREIGN PATENT DOCUMENTS

JP H07-035316 Y2 8/1995
JP 2005-050736 A 2/2005
(Continued)

OTHER PUBLICATIONS

International Search Report dated Aug. 11, 2020 for WO 2020/250642 A1 (6 pages).

*Primary Examiner* — Vanessa Girardi
(74) *Attorney, Agent, or Firm* — Venjuris, P.C.

(57) ABSTRACT

A terminal of the present disclosure is to be connected to a mating terminal and includes a tube portion and a wire connecting portion provided on a rear end part of the tube portion. A resilient contact piece is provided inside the tube portion. The resilient contact piece presses the mating terminal inserted from front of the tube portion toward an inner wall of the tube portion. An upper inspection opening and a lower inspection opening are formed in side walls of the tube portion. The upper inspection opening is formed on an upper side. The lower inspection opening is formed on a lower side (other side). The resilient contact piece is partially exposed from the upper and lower inspection openings with an optical path of light entering from either one of the upper or lower inspection opening and coming out from the other secured.

4 Claims, 12 Drawing Sheets

(51) Int. Cl.

| | |
|---|---|
| ***H01R 4/18*** | (2006.01) |
| ***H01R 4/28*** | (2006.01) |
| *H01R 43/16* | (2006.01) |

(56) References Cited

U.S. PATENT DOCUMENTS

| | | | | |
|---|---|---|---|---|
| 7,048,597 | B2 * | 5/2006 | Chen | H01R 13/187 439/856 |
| 7,101,233 | B2 * | 9/2006 | Maeda | H01R 13/11 439/852 |
| 7,347,747 | B2 * | 3/2008 | Shimizu | H01R 13/11 439/852 |
| 7,462,080 | B2 * | 12/2008 | Shiraishi | H01R 13/113 439/852 |
| 9,105,995 | B2 * | 8/2015 | Tsuji | H01R 13/187 |
| 9,941,615 | B2 * | 4/2018 | Saito | H01R 13/114 |
| 2020/0266556 | A1 | 8/2020 | Takeuchi et al. | |

FOREIGN PATENT DOCUMENTS

| | | | |
|---|---|---|---|
| JP | 2012-151007 | A | 8/2012 |
| JP | 2013-069497 | A | 4/2013 |
| JP | 2014-241269 | A | 12/2014 |
| JP | 2017-143028 | A | 8/2017 |

* cited by examiner

TERMINAL AND WIRE WITH TERMINAL

CROSS REFERENCE TO RELATED APPLICATIONS

This application is a national phase of PCT application No. PCT/JP2020/020312, filed on 22 May 2020, which claims priority from Japanese patent application No. 2019-108474, filed on 11 Jun. 2019, all of which are incorporated herein by reference.

TECHNICAL FIELD

The present disclosure relates to a terminal and a wire with terminal.

BACKGROUND

Conventionally, a terminal is known which includes a tube portion, into which a mating terminal is inserted, and a wire connecting portion to be connected to a wire (see, for example, Patent Document 1). Specifically, an aluminum wire crimping terminal described in Patent Document 1 includes an inter-terminal connecting portion formed into a tubular shape and a plurality of barrels (corresponding to a wire connecting portion) to be connected to a wire.

Generally, such a terminal is provided with a resilient contact piece inside the tube portion, and a mating terminal inserted into the tube portion is pressed toward an inner wall of the tube portion by the resilient contact piece.

PRIOR ART DOCUMENT

Patent Document

Patent Document 1: JP 2005-050736 A

SUMMARY OF THE INVENTION

Problems to be Solved

In the case of manufacturing terminals each provided with a resilient contact piece inside a tube portion, intervals between the resilient contact pieces and the inner walls of the tube portions may vary. If the interval between the resilient contact piece and the inner wall is large, the connection of the mating terminal and the terminal is loose. Conversely, if the interval is small, a large force is necessary when a worker inserts the mating terminal into the tube portion, thereby reducing workability.

Thus, the aforementioned intervals have been conventionally inspected. Specifically, light is, for example, irradiated to a front opening of the tube portion from outside the tube portion and the light coming out from a rear opening is received by a light receiver, and the interval is inspected from a light reception result.

In the case of the aluminum wire crimping terminal described in Patent Document 1, if light is irradiated toward a front opening (opening on a side opposite to an opening on a side where the barrels are provided) of the inter-terminal connecting portion, part of the irradiated light passes through the inside of the inter-terminal connecting portion and comes out from a rear opening (opening on the side where the barrels are provided) even if the wire is connected. Thus, easy inspection is possible.

However, depending on the shape of the wire connecting portion, the propagation of the light may be obstructed by the wire connecting portion and the light may not propagate straight inside the tube portion. Alternatively, even if part of the light propagates straight inside the tube portion, a cross-sectional area of an optical path becomes narrower due to the presence of the wire connecting portion and a sufficient amount of the light may not come out. In such a case, the interval cannot be accurately inspected.

A technique capable of accurately inspecting an interval between a resilient contact piece and an inner wall of a tube portion without depending on the shape of a wire connecting portion is disclosed in this specification.

Means to Solve the Problem

The present disclosure is directed to a terminal to be connected to a mating terminal, the terminal including a tube portion and a wire connecting portion, wherein the wire connecting portion is provided on a rear end part of the tube portion, a resilient contact piece is provided inside the tube portion, the resilient contact piece presses the mating terminal inserted from front of the tube portion toward an inner wall of the tube portion, a first opening and a second opening are formed in side walls of the tube portion, and the first opening is formed on one side in a direction intersecting a pressing direction of the mating terminal by the resilient contact piece, the second opening is formed on the other side, and the resilient contact piece is partially exposed from the first and second openings with an optical path of light entering from either one of the first or second opening and coming out from the other secured.

Effect of the Invention

According to the present disclosure, it is possible to accurately inspect an interval between a resilient contact piece and an inner wall of a tube portion without depending on the shape of a wire connecting portion.

DETAILED DESCRIPTION TO EXECUTE THE INVENTION

Description of Embodiments of Present Disclosure

Figure 1:
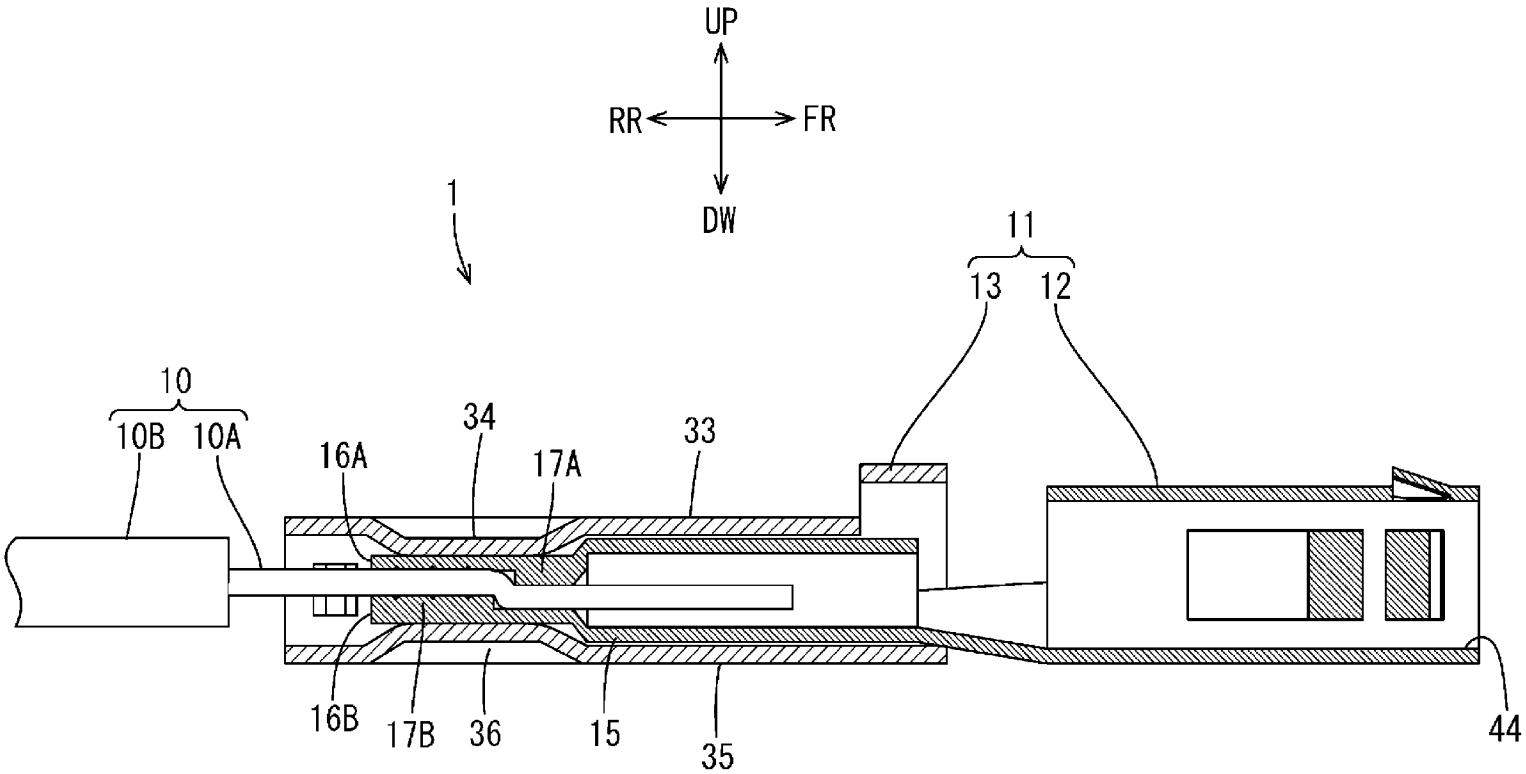
FIG. 1 is a section (section along A-A shown in FIG. 7) of a wire with terminal according to one embodiment.

First, embodiments of the present disclosure are listed and described.

(1) The terminal of the present disclosure is a terminal to be connected to a mating terminal and includes a tube portion and a wire connecting portion, wherein the wire connecting portion is provided on a rear end part of the tube portion, a resilient contact piece is provided inside the tube portion, the resilient contact piece presses the mating terminal inserted from front of the tube portion toward an inner wall of the tube portion, a first opening and a second opening are formed in side walls of the tube portion, and the first opening is formed on one side in a direction intersecting a pressing direction of the mating terminal by the resilient contact piece, the second opening is formed on the other side, and the resilient contact piece is partially exposed from the first and second openings with an optical path of light entering from either one of the first or second opening and coming out from the other secured.

According to the above terminal, since the wire connecting portion is not present on a path from the first opening to the second opening, an interval between the resilient contact piece and the inner wall of the tube portion can be accurately inspected without depending on the shape of the wire connecting portion, for example, by irradiating light toward the first opening from outside the tube portion and inspecting the interval based on a light reception result of the light having passed through the first and second openings and received by a light receiver.

(2) Preferably, the tube portion is shaped by annularly bending a plate-like metal member and connecting one and the other end parts in a circumferential direction of the metal member and includes a locking piece, a third opening and a locked piece, the locking piece protrudes from an edge part of the one end part, the third opening is at least partially formed in the locking piece, the locked piece protrudes from an edge part of the other end part and is inserted into the third opening, and either one of the first or second opening is integrated with the third opening.

If the first and second openings are provided, there is a concern that the strength of the terminal is reduced. Since either one of the first or second opening is integrated with the third opening according to the above terminal, a reduction in the strength of the terminal can be suppressed as compared to the case where the one opening is formed separately from the third opening.

(3) Preferably, a protrusion projecting inward is formed on the inner wall of the tube portion, the mating terminal pressed by the resilient contact piece contacts the protrusion, the locked piece is formed on an edge part of the inner wall where the protrusion is formed, and a surface of the locked piece facing inwardly of the tube portion is formed to be located on the same plane as or outward of a tip of the protrusion.

If the surface of the locked piece is closer to the resilient contact piece than the protrusion, a part of the optical path from the first opening to the second opening is blocked by the locked piece and a cross-sectional area of the optical path becomes smaller. If the cross-sectional area of the optical path becomes smaller, a sufficient amount of light does not come out, whereby there is a possibility that the interval cannot be inspected. According to the above terminal, since the surface of the locked piece facing inwardly of the tube portion is formed to be located on the same plane as or outward of the tip of the protrusion, a reduction in the cross-sectional area of the optical path due to the locked piece can be suppressed.

(4) Preferably, the wire connecting portion includes a wire sandwiching piece, and the wire sandwiching piece sandwiches a core of a wire.

According to the above terminal, the wire can be connected to the terminal by the wire sandwiching piece sandwiching the core of the wire. However, with the wire sandwiched by the wire sandwiching piece, the cross-sectional area of the optical path becomes narrower due to the presence of the wire sandwiching piece and a sufficient amount of light does not possibly come out. Since the wire sandwiching piece is not present on the optical path from the first opening to the second opening (or optical path from the second opening to the first opening) according to the above terminal, a sufficient amount of light comes out without depending on the shape of the wire connecting portion by properly setting areas of the first and second openings. Therefore, the interval can be accurately inspected without depending on the shape of the wire connecting portion.

(5) A wire with terminal of the present disclosure includes the terminal of any one of (1) to (4), and a wire connected to the wire connecting portion.

According to the above wire with terminal, the interval between the resilient contact piece and the inner wall of the tube portion can be accurately inspected without depending on the shape of the wire connecting portion.

Details of Embodiment of Present Disclosure

A specific example of a wire with terminal of the present disclosure is described below with reference to the drawings. The present invention is not limited to these illustrations and is intended to be represented by claims and include all changes in the scope of claims and in the meaning and scope of equivalents.

Embodiment

One embodiment of the present disclosure is described with reference to FIGS. 1 to 11. In the following description, a vertical direction, a front-rear direction and a lateral direction are based on a vertical direction, a front-rear direction and a lateral direction shown in FIG. 2. In each figure, UP, DW, FR, RR, L and R attached to arrows indicating directions respectively mean an upward direction, a downward direction, a forward direction, a rearward direction, a leftward direction and a rightward direction. For a plurality of identical members, only some may be denoted by a reference sign and the others may not be denoted by the reference sign.

As shown in FIG. 1, a wire with terminal 1 according to this embodiment includes a wire 10 and a terminal 11 connected to the wire 10.

[Wire 10]

As shown in FIG. 1, the wire 10 is disposed to extend in the front-rear direction. The wire 10 is such that the outer periphery of a core 10A is surrounded by an insulation coating 10B made of insulating synthetic resin. The core 10A according to this embodiment is made of one metal wire. The core 10A may be a stranded wire formed by twisting a plurality of metal thin wires. A metal such as copper, copper alloy, aluminum or aluminum alloy can be appropriately selected, if necessary, as a metal constituting the core 10A. The core 10A according to this embodiment is made of copper or copper alloy.

[Terminal 11]

Figure 2:
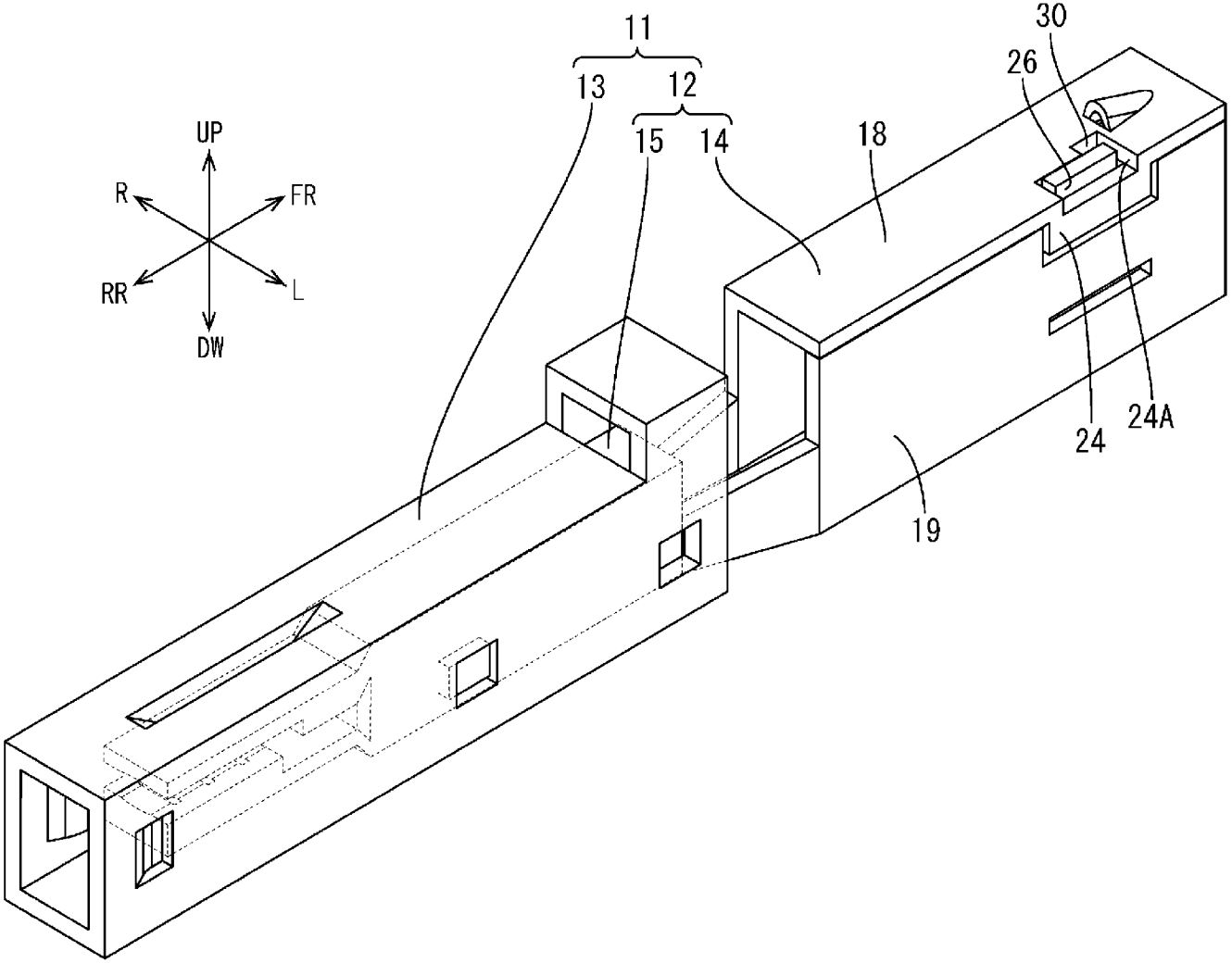
FIG. 2 is a perspective view of a terminal.

As shown in FIG. 2, the terminal 11 is in the form of a rectangular tube as a whole and includes a terminal body 12 made of metal and a slide portion 13 slidable in the front-rear direction with respect to the terminal body 12.

[Terminal Body 12]

Figure 3:
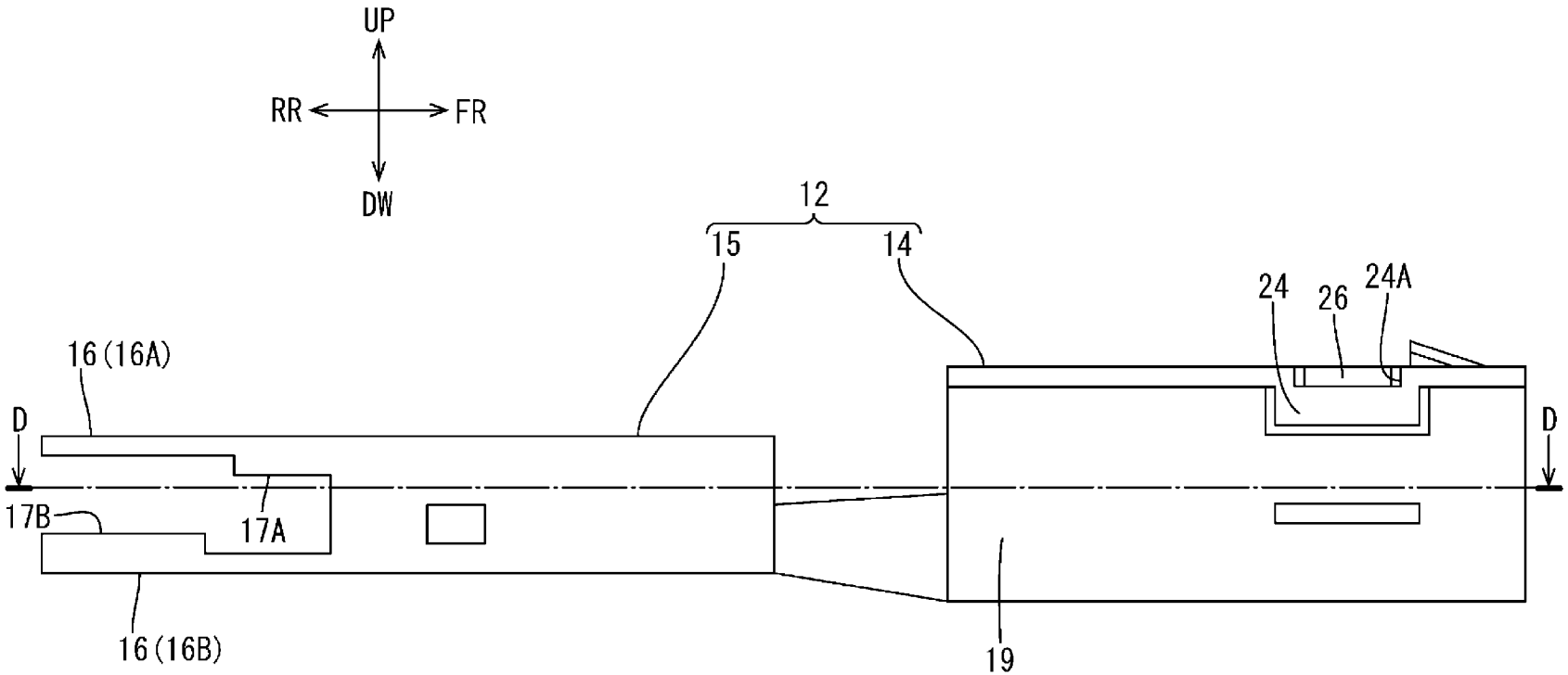
FIG. 3 is a left side view of the terminal.

As shown in FIG. 3, the terminal body 12 includes a tube portion 14, into which an unillustrated mating terminal is inserted from front, and a wire connecting portion 15 located behind the tube portion 14 and to be connected to the wire 10.

The terminal body 12 is formed by press-working a plate-like metal member formed into a predetermined shape. A metal such as copper, copper alloy, aluminum, aluminum alloy or stainless steel can be appropriately selected, if necessary, as the metal constituting the terminal body 12. The terminal body 12 according to this embodiment is made of copper or copper alloy. A plating layer may be formed on the surface of the terminal body 12. A metal such as tin, nickel or silver can be appropriately selected, if necessary, as a metal constituting the plating layer. Tin plating is applied to the terminal body 12 according to this embodiment.

[Wire Connecting Portion 15]

As shown in FIG. 2, the wire connecting portion 15 is in the form of a rectangular tube extending in the front-rear direction. As shown in FIG. 1, the wire connecting portion 15 includes a pair of wire sandwiching pieces 16 (upper sandwiching piece 16A and lower sandwiching piece 16B) for sandwiching the core 10A of the wire 10. The upper sandwiching piece 16A extends rearward from the upper wall of the wire connecting portion 15. The lower sandwiching piece 16B extends rearward from the lower wall of the wire connecting portion 15. The upper and lower sandwiching pieces 16A, 16B have a shape elongated in the front-rear direction. Lengths in the front-rear direction of the upper and lower sandwiching pieces 16A, 16B are substantially equal.

An upper holding protrusion 17A is provided on the lower surface of the upper sandwiching piece 16A. A lower holding protrusion 17B is provided on the upper surface of the lower sandwiching piece 16B. The lower holding protrusion 17B is provided in a rear end part of the lower sandwiching piece 16B. The rear end of the upper holding protrusion 17A is located forward of the front end of the lower holding protrusion 17B.

[Tube Portion 14]

As shown in FIG. 2, the tube portion 14 is in the form of a rectangular tube extending in the front-rear direction. The tube portion 14 is shaped by annularly bending the aforementioned plate-like metal member and connecting one circumferential end part (left end part of an upper wall 18) and the other circumferential end part (upper end part of a left side wall 19). A locking piece 24 is integrally formed on a left edge part of the upper wall 18. The locking piece 24 is a rectangular piece protruding from the left edge part and bent downward. The locking piece 24 is formed with a substantially rectangular opening 24A (an example of a third opening). In this embodiment, the opening 24A is formed from the left edge part of the upper wall 18 to the locking piece 24.

Figure 4:
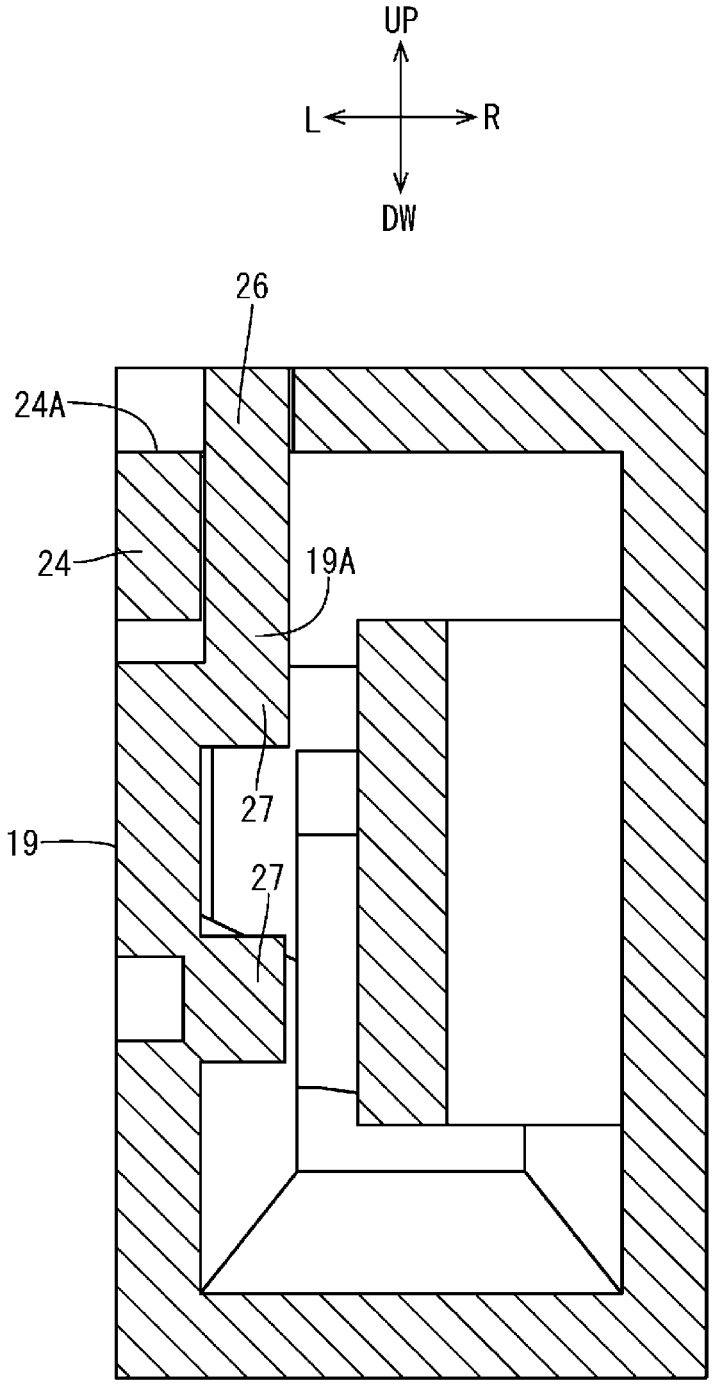
FIG. 4 is a section along B-B shown in FIG. 7.

As show in FIG. 4, a region of the left side wall 19 corresponding to the locking piece 24 is formed as a step portion 19A recessed rightward by as much as a thickness of the locking piece 24 from the other region of the left side wall 19. A leftward facing surface of the locking piece 24 is substantially flush with and a leftward facing surface of the left side wall 19 in a region other than the step portion 19A. If a force is applied in a direction to open the left side wall 19 leftward for some cause, the opening is prevented by the contact of the step portion 19A with the locking piece 24.

As shown in FIG. 4, the step portion 19A is formed with a locked piece 26 in the form of a rectangular piece protruding upward. As shown in FIGS. 2 and 3, the locked piece 26 is inserted into the opening 24A. A width in the front-rear direction of the locked piece 26 is smaller than that in the front-rear direction of the opening 24A.

Figure 5:
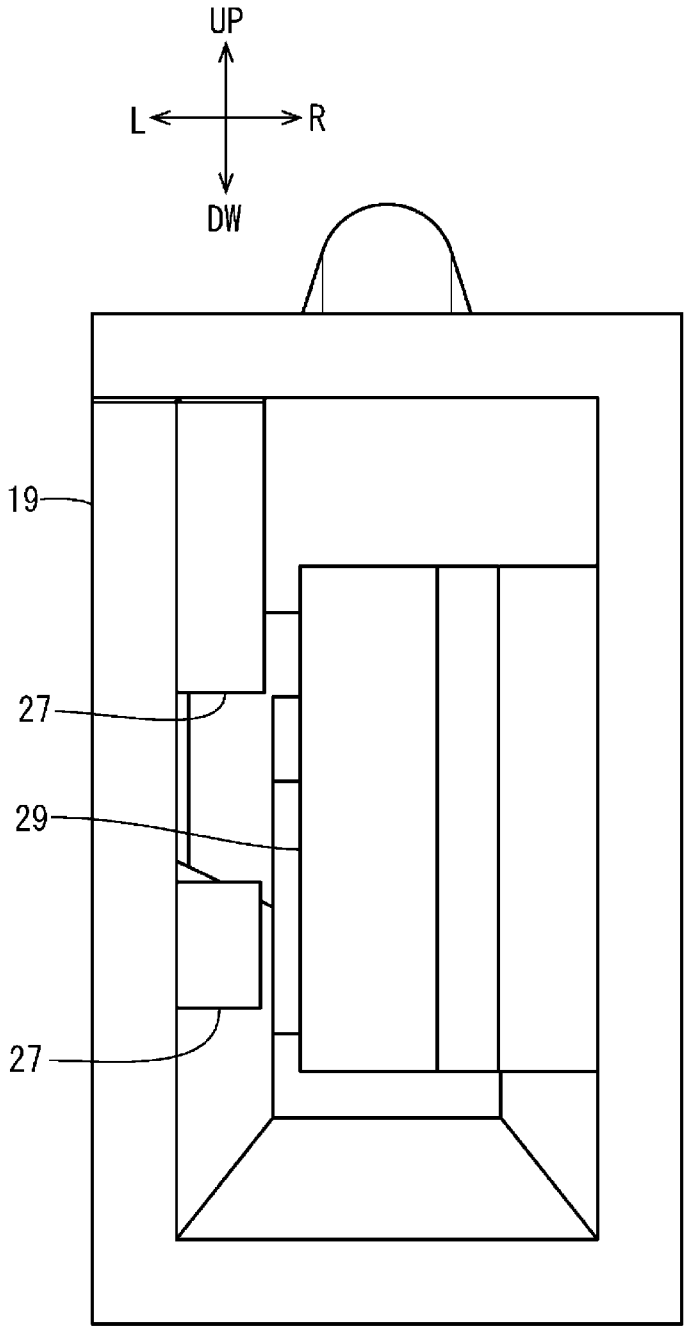
FIG. 5 is a front side view of the terminal.

As shown in FIG. 5, two beads 27 (an example of a protrusion) projecting inward are formed side by side in the vertical direction on the left side wall 19 of the tube portion 14. The mating terminal pressed by a later-described resilient contact piece 29 contacts the beads 27. Each bead 27 extends in the front-rear direction. The bead 27 is formed by press-working the left side wall 19.

As shown in FIG. 4, a section of the upper bead 27 corresponding to the step portion 19A in the front-rear direction is integrated with the step portion 19A. Thus, in this section, the tip of the bead 27 and a surface of the locked piece 26 facing inwardly of the tube portion 14 are formed on the same plane.

Figure 6:
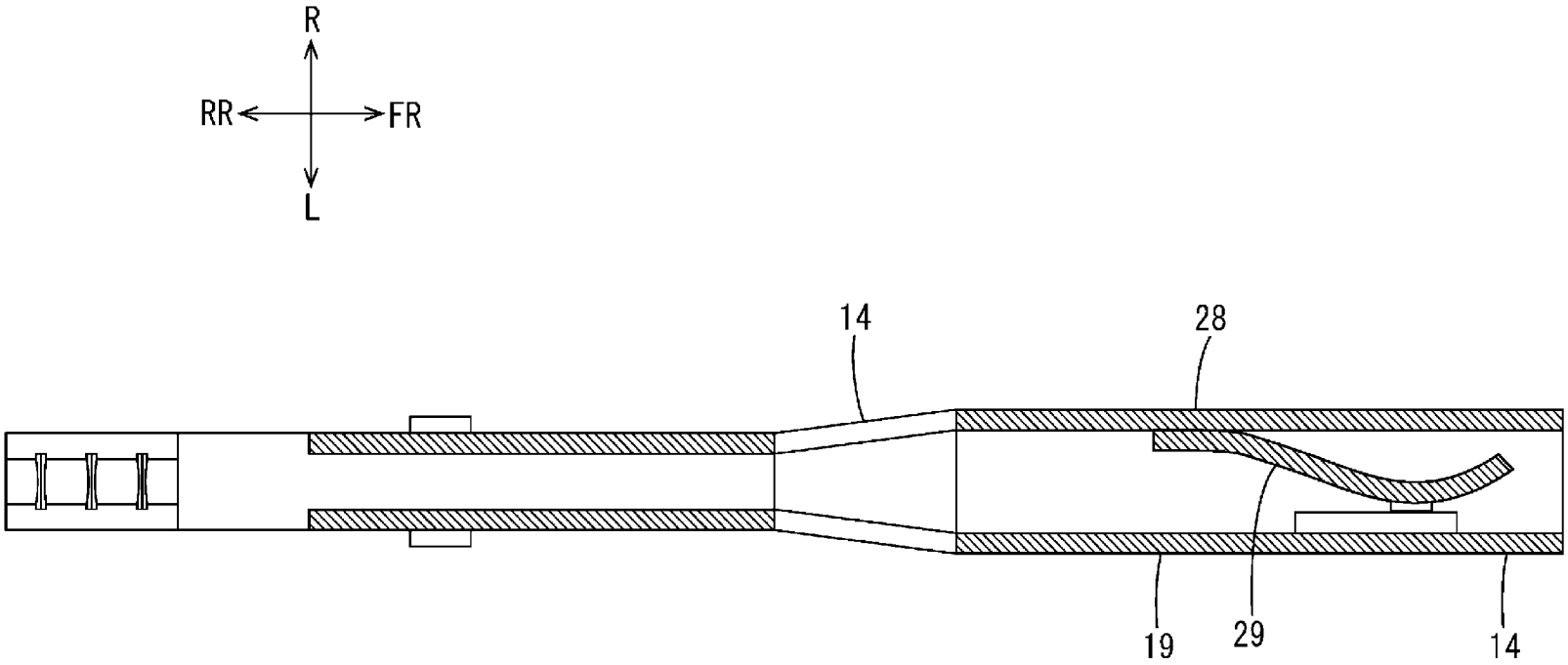
FIG. 6 is a section along D-D shown in FIG. 3.

As shown in FIG. 6, a right side wall 28 of the tube portion 14 is provided with the resiliently deformable resilient contact piece 29. The resilient contact piece 29 is formed into a substantially rectangular shape extending forward with a rear side as a base end. The resilient contact piece 29 is formed into a shape convex leftward by being inclined rightward after being inclined leftward toward a front side. When the mating terminal is inserted into the tube portion 14 from front, the resilient contact piece 29 resiliently contacts the mating terminal, whereby the mating terminal is pressed toward the beads 27. In this way, the mating terminal and the terminal 11 are electrically connected.

The resilient contact piece 29 may be formed separately from the tube portion 14 and fixed to the right side wall 28 by welding or the like, or may be formed by cutting the right side wall 28, or may be formed by turning one circumferential end part of the metal member constituting the tube portion 14 around up to the inside of the right side wall 28 and extending the part turned around to the inside forward.

Figure 7:
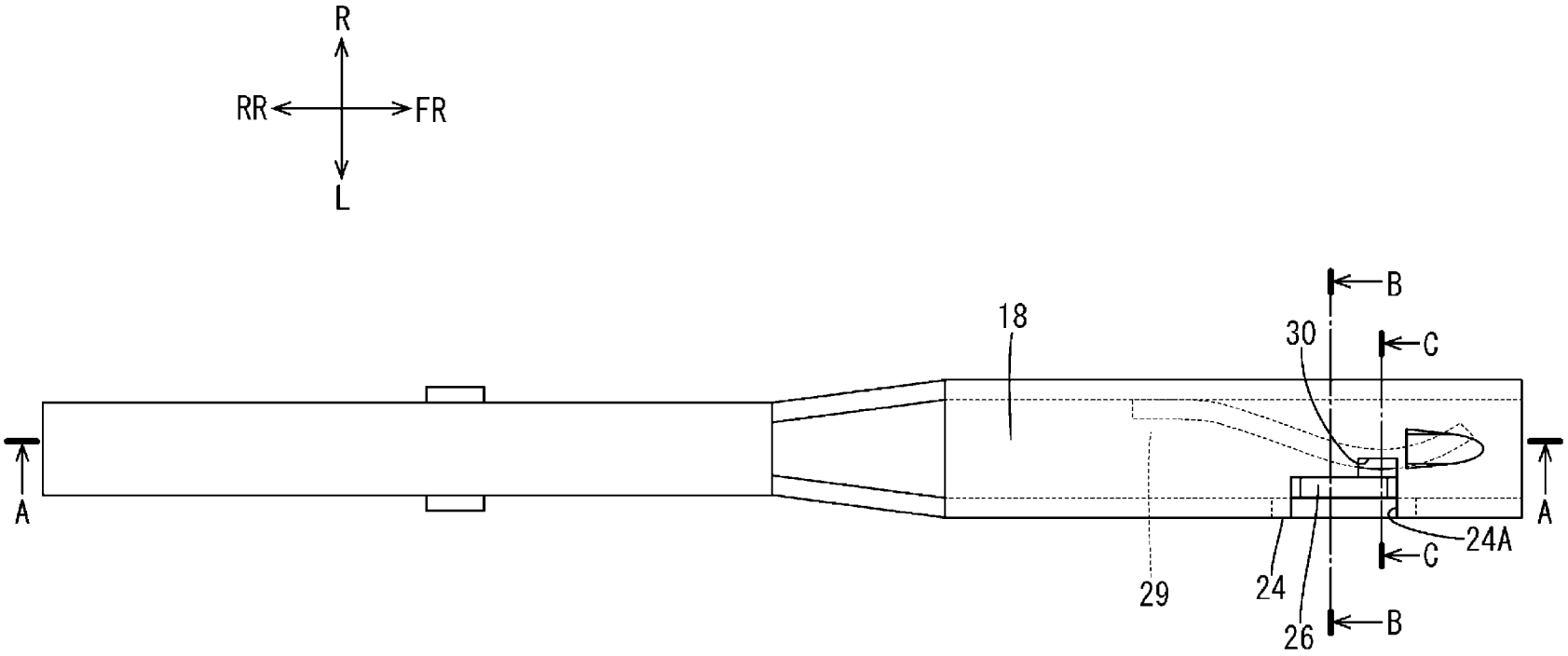
FIG. 7 is a top view of the terminal.

As shown in FIG. 7, the upper wall 18 of the tube portion 14 is formed with a rectangular upper inspection opening 30 (an example of a first opening) for inspecting an interval between the resilient contact piece 29 and the inner wall (more specifically, beads 27) of the tube portion 14. The upper inspection opening 30 is formed by expanding the opening 24A of the locking piece 24. That is, the upper inspection opening 30 is integrated with the opening 24A.

Figure 8:
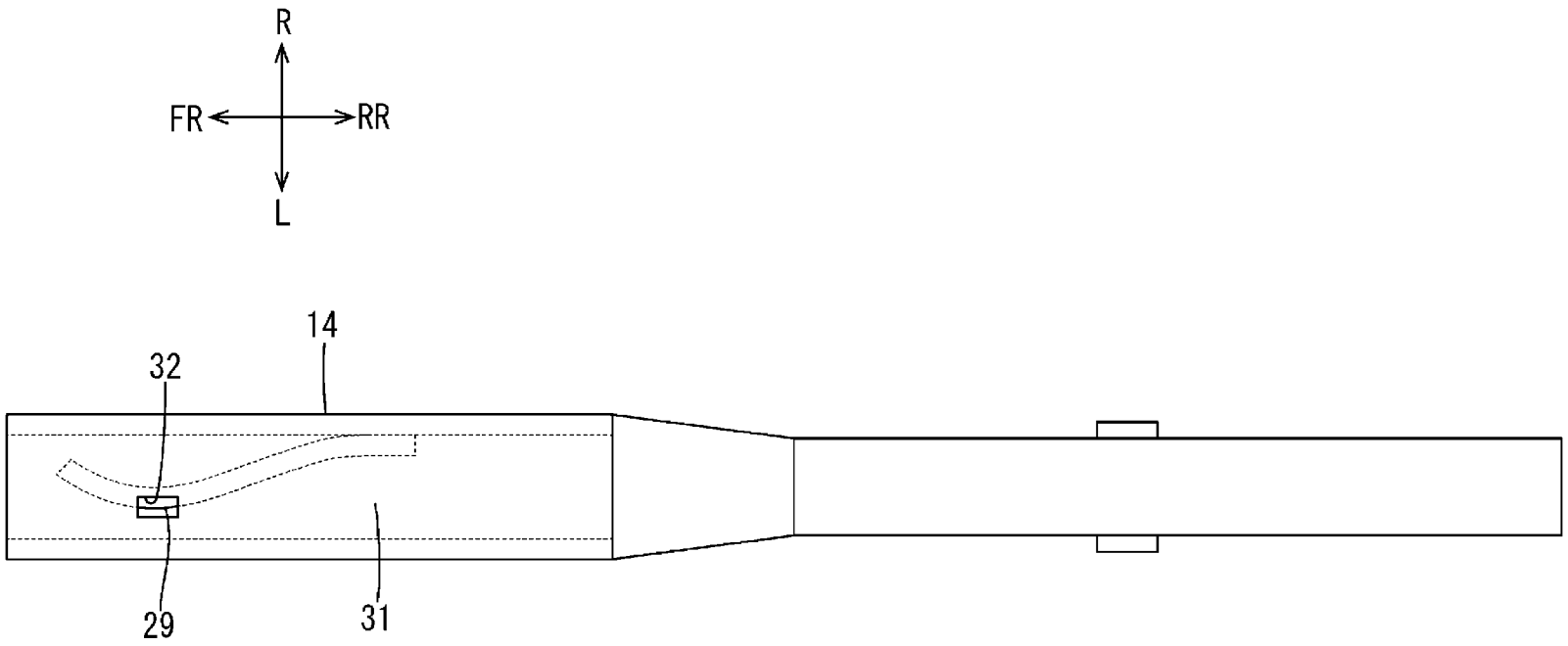
FIG. 8 is a bottom view of the terminal.

As shown in FIG. 8, a bottom wall 31 of the tube portion 14 is formed with a rectangular lower inspection opening 32 (an example of a second opening).

Figure 9:
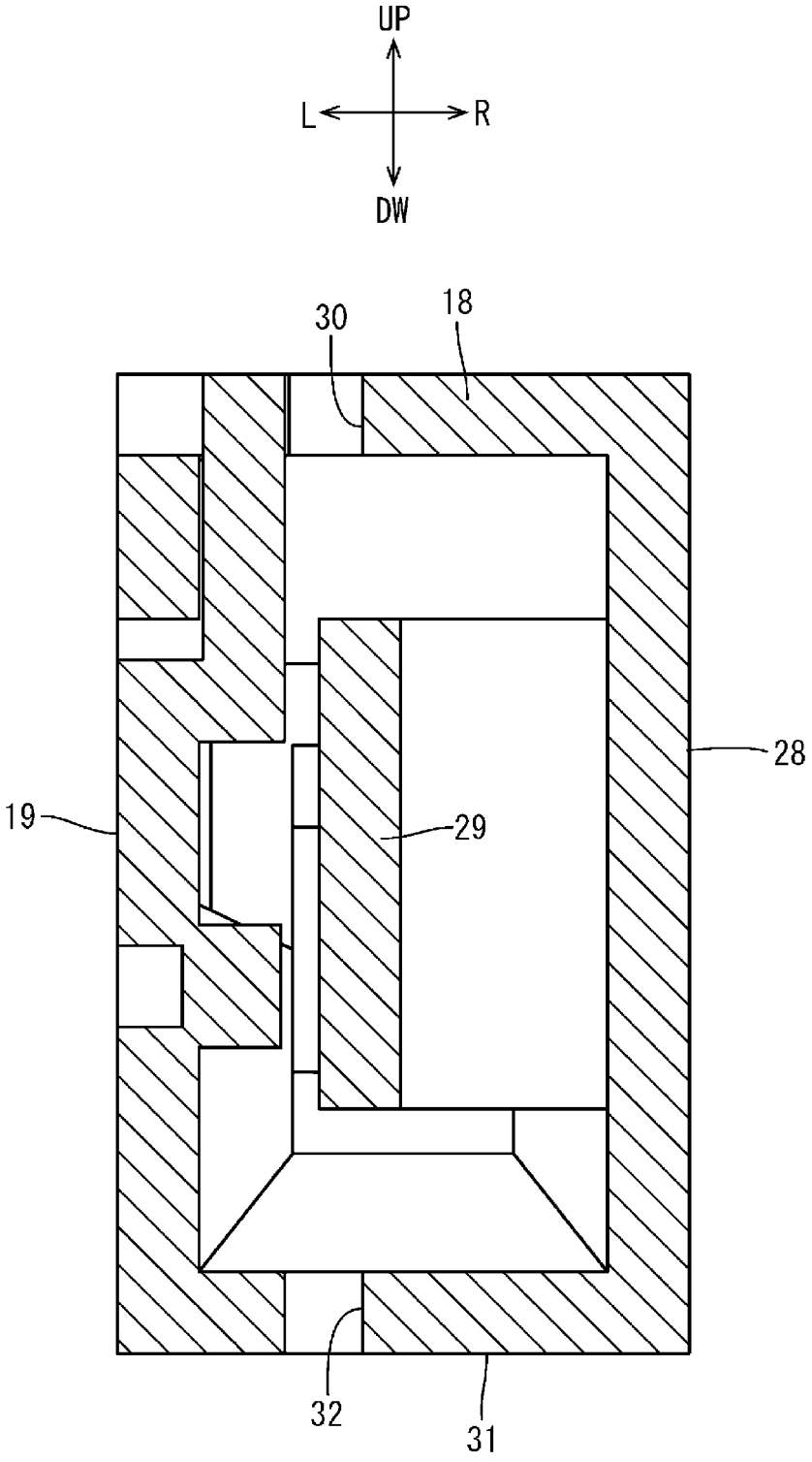
FIG. 9 is a section along C-C shown in FIG. 7.

As shown in FIG. 9, a pressing direction of the mating terminal by the resilient contact piece 29 is a laterally leftward direction. The upper inspection opening 30 is provided on an upper side (an example of one side) in the vertical direction orthogonal to the lateral direction, and the lower inspection opening 32 is provided on a lower side (an example of the other side). The lower inspection opening 32 has the same shape and size as the upper inspection opening 30.

As shown in FIG. 7, the resilient contact piece 29 is partially exposed from the upper inspection opening 30. More specifically, in an example shown in FIG. 7, an inclined part somewhat behind a top part of the resilient contact piece 29 is exposed. The resilient contact piece 29 is similarly exposed from the lower inspection opening 32 shown in FIG. 8.

As shown in FIGS. 7 and 8, the resilient contact piece 29 occupies only parts of ranges seen through the upper inspection opening 30 and the lower inspection opening 32. Thus, light having entered either one of the upper and lower inspection openings 30, 32 can pass through another region of this range and come out from the other inspection opening. That is, an optical path of light entering from either one of the upper and lower inspection openings 30, 32 and coming out from the other is secured.

[Slide Portion 13]

As shown in FIG. 2, the slide portion 13 is in the form of a rectangular tube extending in the front-rear direction. The slide portion 13 is formed by a known method such as cutting, casting or press-working, if necessary. A metal such as copper, copper alloy, aluminum, aluminum alloy or stainless steel can be appropriately selected, if necessary, as a metal constituting the slide portion 13. Although not particularly limited, the slide portion 13 according to this embodiment is made of stainless steel. A plating layer may be formed on the surface of the slide portion 13. A metal such as tin, nickel or silver can be appropriately selected, if necessary, as a metal constituting the plating layer.

An inner cross-sectional shape of the slide portion 13 is the same as or somewhat larger than an outer cross-sectional shape of a region of the terminal body 12 where the upper and lower sandwiching pieces 16A, 16B are provided. In this way, the slide portion 13 is disposed outside the region of the terminal body 12 where the upper and lower sandwiching pieces 16A, 16B are provided.

Figure 10:
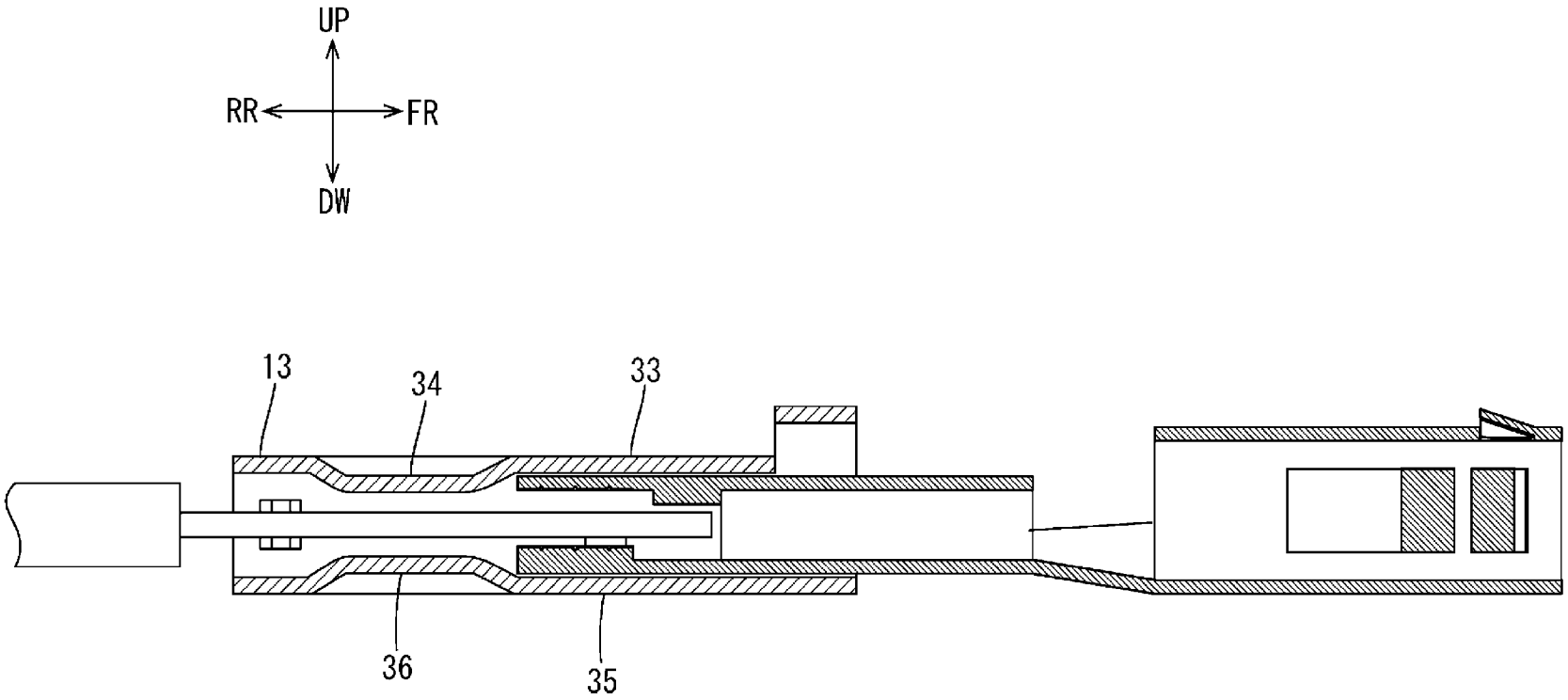
FIG. 10 is a section of the wire with terminal before a slide portion is slid.

As shown in FIG. 10, an upper wall 33 of the slide portion 13 is provided with an upper pressurizing portion 34 projecting downward. A lower wall 35 of the slide portion 13 is provided with a lower pressurizing portion 36 projecting upward.

With reference to FIGS. 1 and 10, the connection of the wire 10 is described. For the connection of the wire 10, the slide portion 13 is slid from a position shown in FIG. 10 to a position shown in FIG. 1. When being moved to the position shown in FIG. 1, the slide portion 13 is locked by an unillustrated locking mechanism, thereby being restricted from moving in the front-rear direction.

In a state shown in FIG. 1, the upper sandwiching piece 16A is resiliently deformed downward by being pressed from above by the upper pressurizing portion 34, and the lower sandwiching piece 16B is resiliently deformed upward by being pressed from below by the lower pressurizing portion 36. In this way, the upper and lower holding protrusions 17A, 17B bite into an oxide film formed on the surface of the core 10A. If these bite into the oxide film, the oxide film is peeled to expose the metal surface of the core 10A. By the contact of this metal surface and the upper and lower holding protrusions 17A, 17B, the core 10A and the wire connecting portion 15 are electrically connected.

[Interval Inspection Process]

The interval inspection process is a process for inspecting the interval between the resilient contact piece 29 and the inner wall (more precisely, beads 27) of the tube portion 14. In this embodiment, the interval inspection process is carried out after the wire 10 is connected to the wire connecting portion 15.

Figure 11:
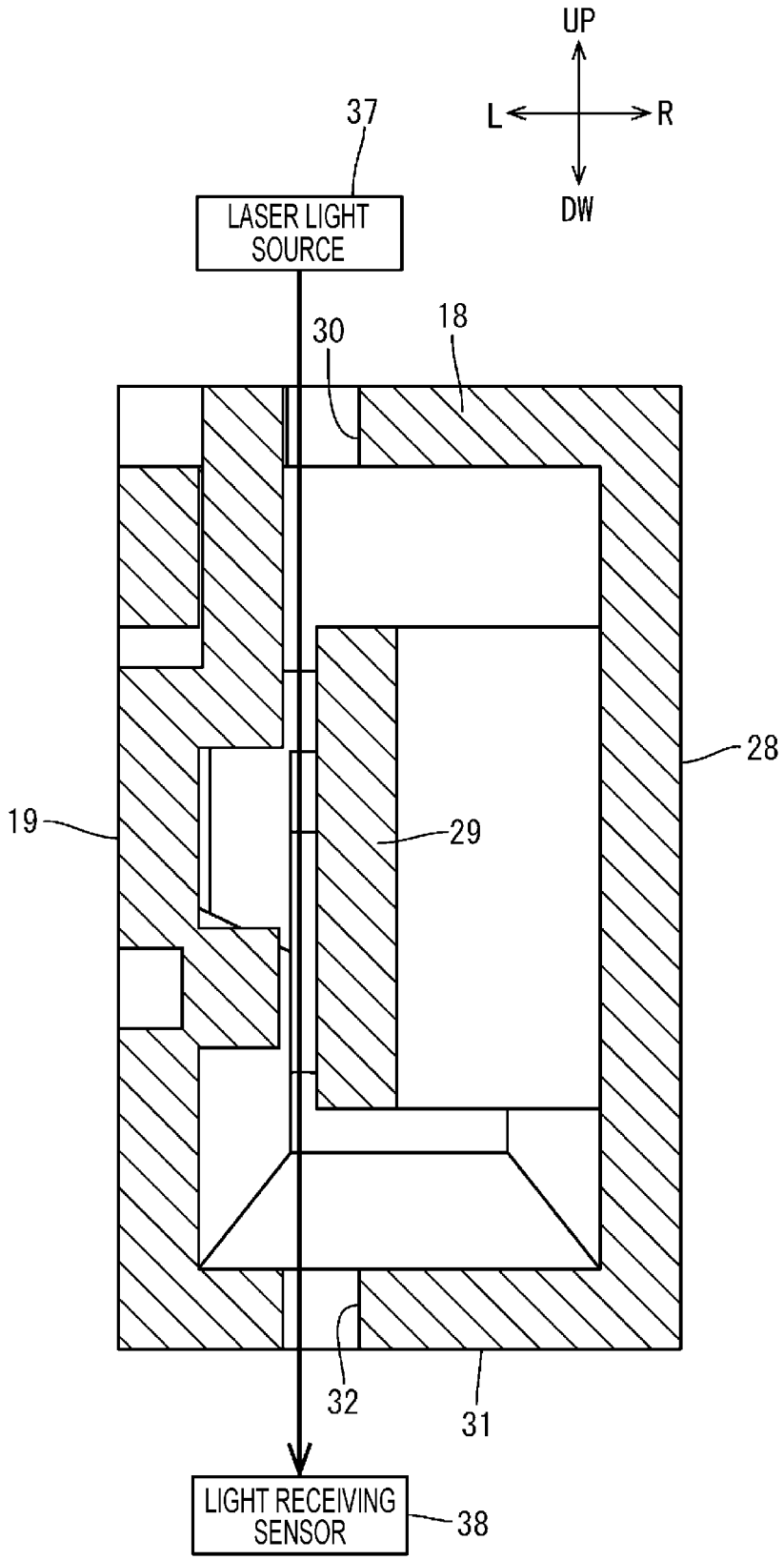
FIG. 11 is a section showing the arrangement of a light source and a light receiver in an interval inspection process.

As shown in FIG. 11, in the interval inspection process, a laser light source (an example of a light source) is arranged above the upper inspection opening 30 and a light receiving sensor (an example of a light receiver) is arranged below the lower inspection opening 32. Laser light is irradiated toward the upper inspection opening 30 from above. The light receiving sensor 38 is an area sensor in which a plurality of light receiving elements are arrayed in a matrix. The laser light source 37 may be arranged below the lower inspection opening 32 and the light receiving sensor 38 may be arranged above the upper inspection opening 30.

The laser light source 37 and the light receiving sensor 38 are connected to an unillustrated computer. If the computer controls the laser light source 37 to irradiate laser light to the upper inspection opening 30, part of the laser light passes through the upper and lower inspection openings 30, 32 and is received by the light receiving sensor 38. The light receiving sensor 38 outputs values representing a light receiving amount of each light receiving element to the computer.

If the interval between the resilient contact piece 29 and the inner wall of the tube portion 14 is small, a cross-sectional area of an optical path of the laser light from the upper inspection opening 30 to the lower inspection opening 32 becomes smaller. Thus, a smaller number of the light receiving elements receive the laser light in the light receiving sensor 38. Conversely, if the interval is large, the cross-sectional area of the optical path becomes larger. Thus, a larger number of the light receiving elements receive the laser light. The computer judges the number of the light receiving elements having a light receiving amount equal to or more than a reference value and judges the interval from the number of the light receiving elements having the light receiving amount equal to or more than the reference value or a ratio of the number of the light receiving elements having the light receiving amount equal to or more than the reference value to a total number of the light receiving elements.

The computer may judge the interval from a total value or average value of the light receiving amounts of the respective light receiving elements. This is because the total value or average value increases as the number of the light receiving elements having received the laser light increases. How to judge the interval from a light reception result of the light receiving sensor 38 can be determined as appropriate.

If the interval is equal to or larger than a predetermined upper limit value (i.e. if the interval is too wide) or equal to or smaller than a predetermined lower limit value (i.e. if the interval is too narrow), the computer judges a defect.

Functions and Effects of Embodiment

The terminal 11 according to this embodiment is to be connected to the mating terminal and includes the tube portion 14 and the wire connecting portion 15, the wire connecting portion 15 is provided on the rear end part of the tube portion 14, the resilient contact piece 29 is provided inside the tube portion 14, the resilient contact piece 29 presses the mating terminal inserted from front of the tube portion 14 toward the inner wall of the tube portion 14, the upper and lower inspection openings 30, 32 are formed in the side walls (upper wall 18 and bottom wall 31) of the tube portion 14, the upper inspection opening 30 is formed on the upper side (one side in the direction intersecting the pressing direction of the mating terminal by the resilient contact piece 29), the lower inspection opening 32 is formed on the lower side (other side), and the resilient contact piece 29 is partially exposed from the upper and lower inspection openings 30, 32 with an optical path of light entering either one of the upper or lower inspection opening 30, 32 and coming out from the other secured.

According to the terminal 11, since the wire connecting portion 15 is not present on a path from the upper inspection opening 30 to the lower inspection opening 32, the interval between the resilient contact piece 29 and the inner wall of the tube portion 14 can be accurately inspected without depending on the shape of the wire connecting portion 15 by irradiating light toward the upper inspection opening 30 from above the tube portion 14 and inspecting the interval based on the light reception result of the light having passed through the upper and lower inspection openings 30, 32 and received by the light receiving sensor 38.

According to the terminal 11, since an interval between the upper and lower inspection openings 30, 32 is shorter than a length of the terminal body 12, light is less likely to be diffused as compared to the case where light is irradiated toward the front opening of the tube portion 14 from outside the tube portion 14. Thus, there is also an advantage of improving inspection accuracy as compared to the case where light is irradiated toward the front opening.

The tube portion 14 of the terminal 11 is shaped by annularly bending the plate-like metal member and connecting one and the other end parts in a circumferential direction of the metal member, the tube portion 14 includes the locking piece 24, the opening 24A (third opening) and the locked piece 26, the locking piece 24 protrudes from the edge part of the one end part, the opening 24A is at least partially formed in the locking piece 24, the locked piece 26 protrudes from the edge part of the other end part and is inserted into the opening 24A, and the upper inspection opening 30 is integrated with the opening 24A.

According to the terminal 11, since the upper inspection opening 30 is integrated with the opening 24A, a reduction in the strength of the terminal 11 can be suppressed as compared to the case where the upper inspection opening 30 is formed separately from the opening 24A.

The terminal 11 is formed with the beads 27 projecting inward on the inner wall of the tube portion 14, the mating terminal pressed by the resilient contact piece 29 contacts the beads 27, the locked piece 26 is formed on the edge part of the inner wall formed with the beads 27, and the tips of the beads 27 and the surface of the locked piece 26 facing inwardly of the tube portion 14 are formed on the same plane.

According to the terminal 11, a reduction in the cross-sectional area of the optical path due to the locked piece 26 can be suppressed.

The wire connecting portion 15 of the terminal 11 includes the wire sandwiching pieces 16 and the wire sandwiching pieces 16 sandwich the core 10A of the wire 10.

According to the terminal 11, the wire sandwiching pieces 16 sandwich the core 10A, whereby the wire can be connected to the terminal 11. However, since the wire 10 is sandwiched by the wire sandwiching pieces 16 (upper and lower sandwiching pieces 16A, 16B) as shown in FIG. 1, the propagation of light is obstructed by the wire sandwiching pieces 16 and the light cannot propagate straight inside the tube portion 14 if the light is irradiated toward the front opening of the tube portion 14 from outside the tube portion 14. Alternatively, even if part of the light propagates straight inside the tube portion 14, a cross-sectional area of an optical path becomes narrower due to the presence of the wire connecting portion 15 and a sufficient amount of the light does not come out.

According to the terminal 11, since the wire sandwiching pieces 16 are not present on the optical path from the upper inspection opening 30 to the lower inspection opening 32 (or on the optical path from the lower inspection opening 32 to the upper inspection opening 30), a sufficient amount of light comes out without depending on the shape of the wire connecting portion 15 by properly setting areas of the upper and lower inspection openings 30, 32. Thus, the interval can be accurately inspected without depending on the shape of the wire connecting portion 15.

The wire with terminal 1 according to this embodiment includes the terminal 11 and the wire 10 connected to the wire connecting portion 15.

According to the wire with terminal 1, without depending on the shape of the wire connecting portion 15, the interval between the resilient contact piece 29 and the inner wall of the tube portion 14 can be accurately inspected with the wire 10 connected to the terminal 11.

Other Embodiments (1) Although the wire connecting portion 15 includes the upper sandwiching piece 16A, the lower sandwiching piece 16B and the slide portion 13 in the above embodiment, the configuration of the wire connecting portion 15 is not limited to this and can adopt any configuration.

Figure 12:
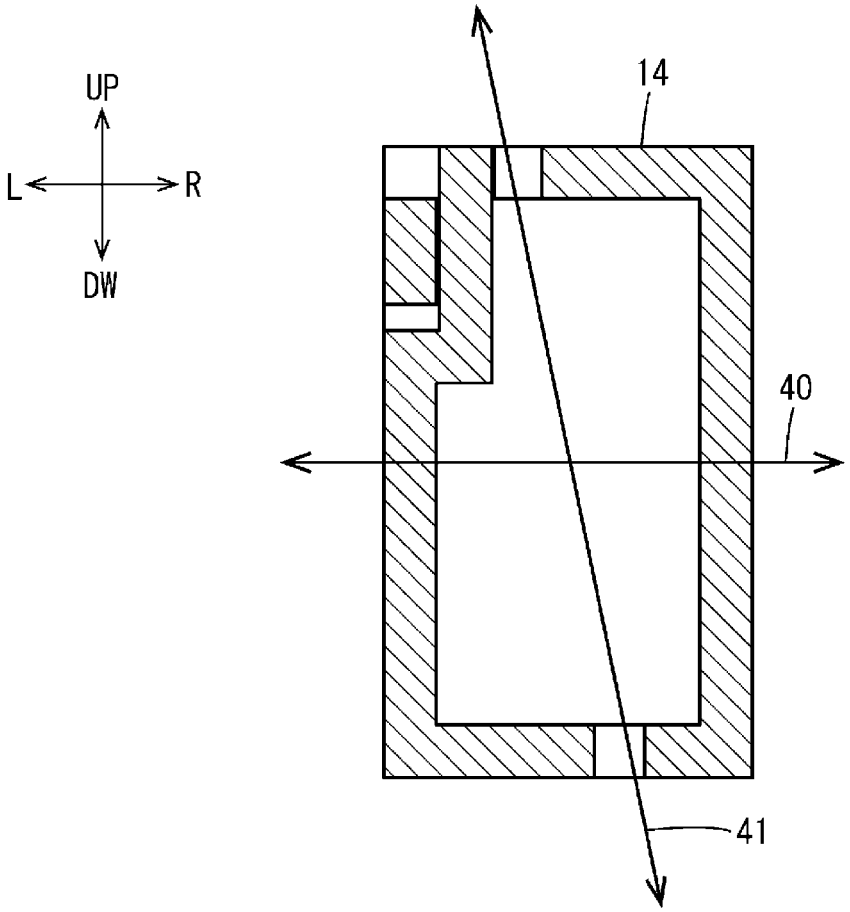
FIG. 12 is a section of a tube portion according to another embodiment.

(2) In the above embodiment, the pressing direction of the mating terminal by the resilient contact piece 29 is the lateral direction and the direction intersecting the pressing direction of the mating terminal by the resilient contact piece 29 is the vertical direction. That is, the intersecting direction is orthogonal to the pressing direction of the mating terminal by the resilient contact piece 29. However, the intersecting direction is not limited to the direction orthogonal to the pressing direction of the mating terminal by the resilient contact piece 29. For example, as schematically shown in FIG. 12, an intersecting direction 41 may be inclined with respect to a pressing direction 40 of the mating terminal by the resilient contact piece 29.

Figure 13:
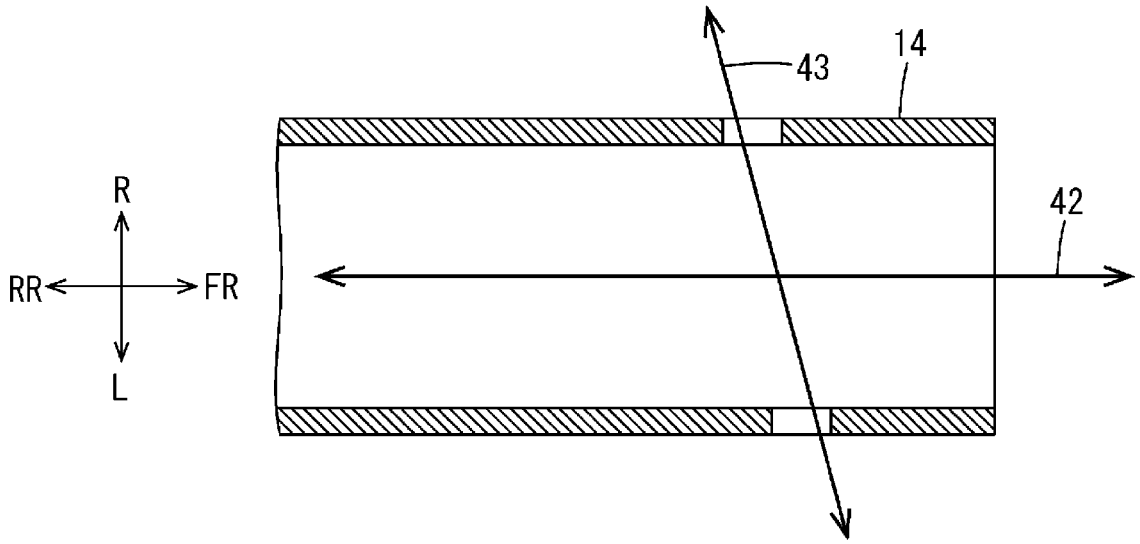
FIG. 13 is a section of a tube portion according to another embodiment.

(3) In the above embodiment, the direction intersecting the pressing direction of the mating terminal by the resilient contact piece 29 is orthogonal to an axial direction of the tube portion 14. However, the intersecting direction is not limited to the direction orthogonal to the axial direction of the tube portion 14. For example, as schematically shown in FIG. 13, an intersecting direction 43 may be inclined with respect to an axial direction 42 of the tube portion 14.

(4) Although the shape and size of the upper inspection opening 30 are the same as the shape and size of the lower inspection opening 32 in the above embodiment, these may not necessarily be the same if the interval between the resilient contact piece 29 and the inner wall of the tube portion 14 can be inspected. For example, the lower inspection opening 32 may be larger or smaller than the upper inspection opening 30. The shape of the lower inspection opening 32 may be different from that of the upper inspection opening 30.

(5) Although the upper inspection opening 30 and the opening 24A of the locking piece 24 are integrated in the above embodiment, the upper inspection opening 30 may be formed as an opening independent of the opening 24A.

(6) Although the upper inspection opening 30 and the opening 24A of the locking piece 24 are integrated in the above embodiment, the lower inspection opening 32 may be integrated with the opening 24A.

(7) Although the beads 27 are formed on the inner wall of the tube portion 14 in the above embodiment, the beads 27 may not necessarily be formed.

(8) Although the tube portion 14 has a rectangular tube shape in the above embodiment, the shape of the tube portion 14 is not limited to the rectangular tube shape and may be, for example, a hollow cylindrical shape.

(9) Although the laser light source is used as a light source in the above embodiment, the light source is not limited to the laser light source. For example, the light source may be a light emitting diode (LED).

(10) Although the pair of wire sandwiching pieces 16 are provided in the above embodiment, one, three or more wire sandwiching pieces 16 may be provided.

(11) Although the interval inspection process is carried out after the wire 10 is connected to the wire connecting portio1n 15 in the above embodiment, the interval inspection process may be carried out before the wire 10 is connected to the wire connecting portion 15.

(12) Although the tips of the beads 27 and the surface of the locked piece 26 facing inwardly of the tube portion 14 are formed on the same plane in the above embodiment, the surface of the locked piece 26 facing inwardly of the tube portion 14 may be formed to be located outward of the tips of the beads 27 (leftward of the left ends of the beads 27 in FIG. 4).

LIST OF REFERENCE NUMERALS

1 . . . wire with terminal
2 . . . right side wall
10 . . . wire
10A . . . core
10B . . . insulation coating
11 . . . terminal
12 . . . terminal body
13 . . . slide portion
14 . . . tube portion
15 . . . wire connecting portion
16 . . . wire sandwiching piece
16A . . . upper sandwiching piece
16B . . . lower sandwiching piece
17A . . . upper holding protrusion
17B . . . lower holding protrusion
18 . . . upper wall
19 . . . left side wall
19A . . . step portion
24 . . . locking piece
24A . . . opening (example of third opening)
26 . . . locked piece
27 . . . bead (example of protrusion)
28 . . . right side wall
29 . . . resilient contact piece
30 . . . upper inspection opening (example of first opening)
31 . . . bottom wall
32 . . . lower inspection opening (example of second opening)
33 . . . upper wall
34 . . . upper pressurizing portion
35 . . . lower wall
36 . . . lower pressurizing portion
37 . . . laser light source (example of light source)
38 . . . light receiving sensor (example of light receiver)
40 . . . direction
41 . . . direction
42 . . . axial direction
43 . . . direction

What is claimed is:

1. A terminal to be connected to a mating terminal, comprising:
a tube portion; and
a wire connecting portion,
wherein:
the wire connecting portion is provided on a rear end part of the tube portion,
a resilient contact piece is provided inside the tube portion,
the resilient contact piece presses the mating terminal inserted from front of the tube portion toward an inner wall of the tube portion,
a first opening and a second opening are formed in side walls of the tube portion,
the first opening is formed on one side in a direction intersecting a pressing direction of the mating terminal by the resilient contact piece, the second opening is formed on the other side, and the resilient contact piece is partially exposed from the first and second openings with an optical path of light entering from either one of the first or second opening and coming out from the other secured,
the tube portion is shaped by annularly bending a plate-like metal member and connecting one and the other end parts in a circumferential direction of the metal member and includes a locking piece, a third opening and a locked piece,
the locking piece protrudes from an edge part of the one end part,
the third opening is at least partially formed in the locking piece,
the locked piece protrudes from an edge part of the other end part and is inserted into the third opening, and
either one of the first or second opening is integrated with the third opening.

2. The terminal of claim 1, wherein:
a protrusion projecting inward is formed on the inner wall of the tube portion,
the mating terminal pressed by the resilient contact piece contacts the protrusion,
the locked piece is formed on an edge part of the inner wall where the protrusion is formed, and
a surface of the locked piece facing inwardly of the tube portion is located on the same plane as or outward of a tip of the protrusion.

3. The terminal of claim 1, wherein:
the wire connecting portion includes a wire sandwiching piece, and
the wire sandwiching piece sandwiches a core of a wire.

4. A wire with terminal, comprising:
the terminal of claim 1; and
a wire connected to the wire connecting portion.

* * * * *